US008613324B2

(12) United States Patent
Nguyen

(10) Patent No.: US 8,613,324 B2
(45) Date of Patent: Dec. 24, 2013

(54) SINGLE TRIP POSITIVE LOCK ADJUSTABLE HANGER LANDING SHOULDER DEVICE

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 231 days.

(21) Appl. No.: 13/130,302

(22) PCT Filed: Dec. 8, 2009

(86) PCT No.: PCT/US2009/067117

§ 371 (c)(1),
(2), (4) Date: May 19, 2011

(87) PCT Pub. No.: WO2010/080294

PCT Pub. Date: Jul. 15, 2010

(65) Prior Publication Data

US 2011/0253389 A1 Oct. 20, 2011

Related U.S. Application Data

(60) Provisional application No. 61/143,642, filed on Jan. 9, 2009.

(51) Int. Cl.
*E21B 23/02* (2006.01)

(52) U.S. Cl.
USPC ..... 166/382; 166/208

(58) Field of Classification Search
USPC ..... 166/382, 208, 88.5
See application file for complete search history.

(56) References Cited

U.S. PATENT DOCUMENTS

| | | | | |
|---|---|---|---|---|
| 3,404,736 | A | 10/1968 | Nelson et al. | |
| 4,416,472 | A | 11/1983 | Fowler et al. | |
| 5,070,942 | A | 12/1991 | McInnes | |
| 5,330,002 | A | 7/1994 | Saunders | |
| 8,256,506 | B2 * | 9/2012 | Dyson et al. | 166/85.1 |
| 2012/0007314 | A1 * | 1/2012 | Nguyen et al. | 277/308 |

OTHER PUBLICATIONS

PCT Search Report and Written Opinion of PCT Application No. PCT/US2009/067117 mailed Jul. 14, 2010.

* cited by examiner

*Primary Examiner* — William P Neuder
(74) *Attorney, Agent, or Firm* — Fletcher Yoder, P.C.

(57) ABSTRACT

A system, in certain embodiments, includes a landing assembly. The landing assembly includes a top ring. The landing assembly also includes a bottom ring disposed axially below the top ring. A radially interior surface of the top ring is configured to engage a radially exterior surface of the bottom ring via first threading. The landing assembly also includes a lock ring disposed between the top ring and the bottom ring on a radially exterior side of the landing assembly. The landing assembly further includes a landing ring disposed axially below the bottom ring.

29 Claims, 8 Drawing Sheets

SINGLE TRIP POSITIVE LOCK ADJUSTABLE HANGER LANDING SHOULDER DEVICE

CROSS-REFERENCE TO RELATED APPLICATIONS

This application claims priority to and benefit of PCT Patent Application No. PCT/US09/67117, entitled "Single Trip Positive Lock Adjustable Hanger Landing Shoulder Device," filed Dec. 8, 2009, which is herein incorporated by reference in its entirety, and which claims priority to and benefit of U.S. Provisional Patent Application No. 61/143,642, entitled "Single Trip Positive Lock Adjustable Hanger Landing Shoulder Device", filed on Jan. 9, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as casings, trees, manifolds, and so forth, which facilitate drilling and/or extraction operations. A long pipe, such as a casing, may be lowered into the earth to enable access to the natural resource. Additional pipes and/or tubes may then be run through the casing to facilitate extraction of the resource. In some instances, it may be desirable to provide a locking mechanism by which one wellhead component (e.g., a hanger) may be held in place within another component (e.g., a casing).

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present invention include systems and methods for locking a landing assembly within a wellhead of a mineral extraction system. In particular, in certain embodiments, the landing assembly may include a top ring, a bottom ring, a landing ring, and a lock ring. A stop shoulder of the wellhead may block the landing assembly from being further lowered into the wellhead. Once the stop shoulder has been reached, the top ring and the landing ring of the landing assembly may be rotated about a hanger within the wellhead via threading in a first rotational direction. Eventually, internal stresses within the landing assembly may break at least one shear pin between the top ring and the bottom ring. After the shear pin(s) break, the bottom ring becomes capable of moving axially upward relative to the top ring. However, at least one guide pin ensures that the bottom ring may not rotate relative to the landing ring. Therefore, the bottom ring may instead begin rotating about the top ring via threading in a second rotational direction opposite to the first rotational direction. As the bottom ring moves axially closer to the top ring, angled exterior surfaces of the top ring and bottom ring gradually force the lock ring out radially, locking the landing assembly in place within the wellhead. This method of locking the landing assembly within the wellhead allows for single trip, adjustable hanger landing.

Figure 1:
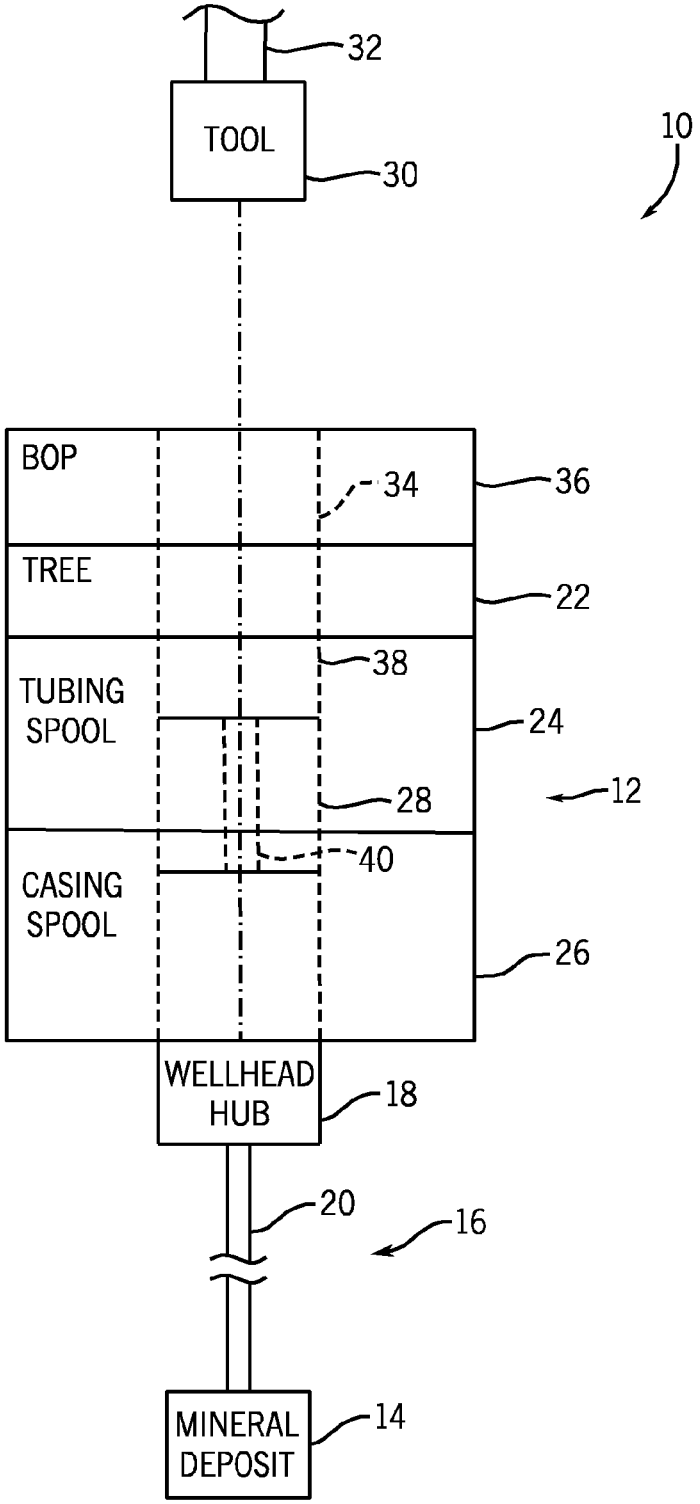
FIG. 1 is a block diagram illustrating a mineral extraction system in accordance with an embodiment of the present invention.

FIG. 1 is a block diagram that illustrates an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or sub-sea (e.g., a sub-sea system). As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and designed to connect the wellhead 12 to the well 16.

The wellhead 12 may include multiple components that control and regulate activities and conditions associated with the well 16. For example, the wellhead 12 generally includes bodies, valves, and seals that route produced minerals from the mineral deposit 14, regulate pressure in the well 16, and inject chemicals down-hole into the well bore 20. In the illustrated embodiment, the wellhead 12 includes what is colloquially referred to as a Christmas tree 22 (hereinafter, a tree), a tubing spool 24, a casing spool 26, and a hanger 28 (e.g., a tubing hanger and/or a casing hanger). The system 10 may include other devices that are coupled to the wellhead 12, and devices that are used to assemble and control various components of the wellhead 12. For example, in the illustrated embodiment, the system 10 includes a running tool 30 suspended from a drill string 32. In certain embodiments, the running tool 30 includes a running tool that is lowered (e.g., run) from an offshore vessel to the well 16 and/or the wellhead 12. In other embodiments, such as surface systems, the running tool 30 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 34. The tree bore 34 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 36 may also be included, either as a part of the tree 22 or as a separate device. The BOP 36 may consist of a variety of valves, fittings, and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular sub-sea or surface mineral extraction system 10 that is run from an offshore vessel or surface system. The tubing spool 24 includes a tubing spool bore 38. The tubing spool bore 38 connects (e.g., enables fluid communication between) the tree bore 34 and the well 16. Thus, the tubing spool bore 38 may provide access to the well bore 20 for various completion and workover procedures. For example, components can be run down to the wellhead 12 and disposed in the tubing spool bore 38 to seal off the well bore 20, to inject chemicals down-hole, to suspend tools down-hole, to retrieve tools down-hole, and so forth.

As will be appreciated, the well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 28 (e.g., tubing hanger or casing hanger) is typically disposed within the wellhead 12 to secure tubing and casing suspended in the well bore 20, and to provide a path for hydraulic control fluid, chemical injections, and so forth. The hanger 28 includes a hanger bore 40 that extends through the center of the hanger 28, and that is in fluid communication with the tubing spool bore 38 and the well bore 20. One or more seal assemblies and/or landing assemblies may be disposed between the hanger 28 and the tubing spool 24 and/or the casing spool 26.

Figure 2:
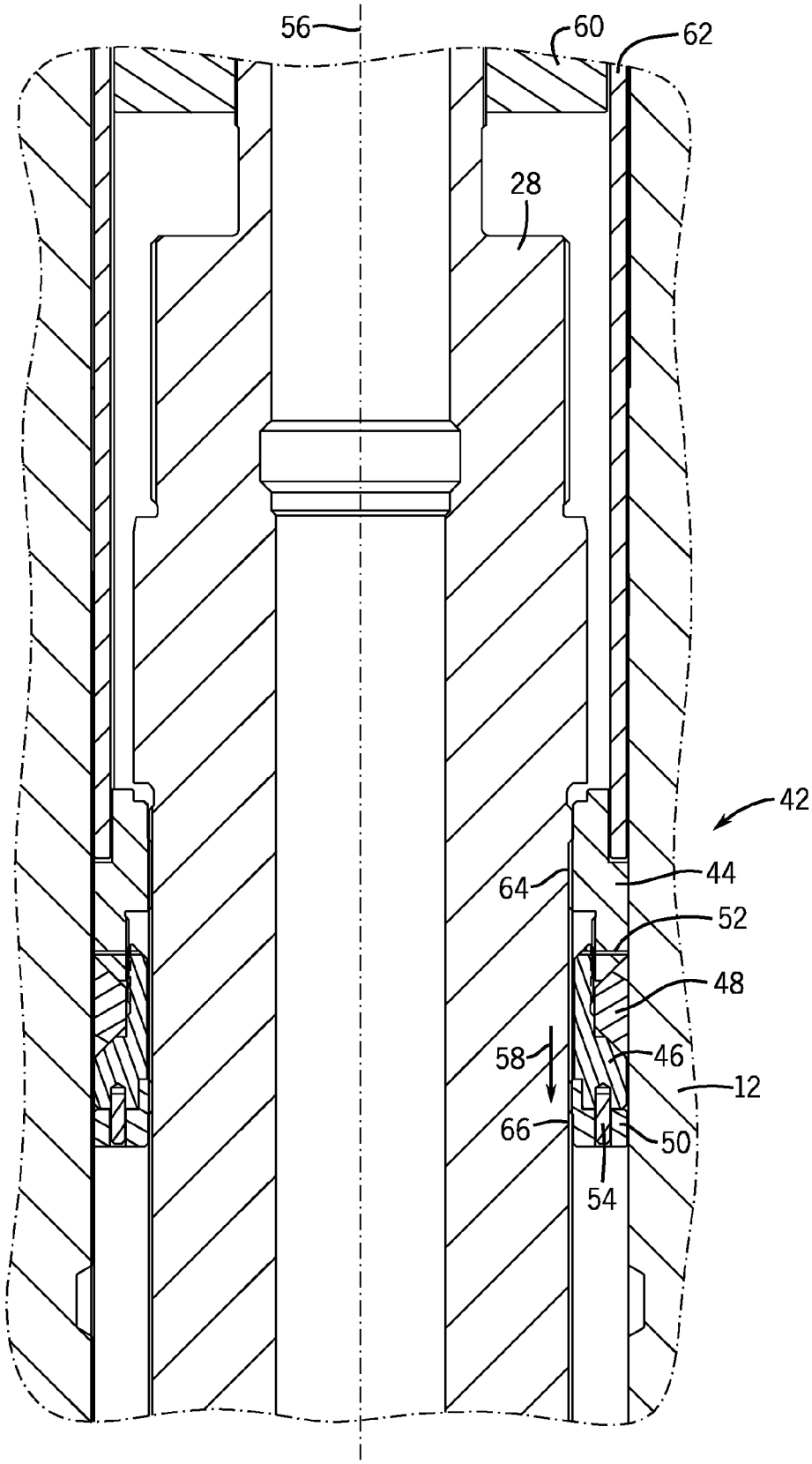
FIG. 2 is a partial cross-section of an adjustable hanger landing assembly disposed between the hanger and the wellhead of FIG. 1.

FIG. 2 depicts a partial cross-section of an adjustable hanger landing assembly 42 disposed between the hanger 28 and the wellhead 12 of FIG. 1. In certain embodiments, the landing assembly 42 may include a top ring 44, a bottom ring 46, a lock ring 48, and a landing ring 50. The landing assembly 42 may also include at least one shear pin 52 which initially connects the top ring 44 to the bottom ring 46. In addition, the landing assembly 42 may include at least one guide pin 54, which may be used to ensure that the bottom ring 46 may not rotate relative to the landing ring 50. More specifically, as described in greater detail below, the guide pin(s) 54 may be used to ensure that the bottom ring 46 may only move axially along the longitudinal axis 56 of the wellhead 12 relative to the landing ring 50. Both the shear pin(s) 52 and the guide pin(s) 54 may include a plurality of pins spaced about the landing ring 42. However, in certain embodiments, only one shear pin 52 and one guide pin 54 may be used. Indeed, as described below, only one shear pin 52 and one guide pin 54 may be used for carrying out the present techniques.

The hanger 28 and the landing assembly 42 may be lowered ("run") axially into the wellhead 12 together, as illustrated by arrow 58. In certain embodiments, a first running tool 60 may be used to lower the hanger 28 into the wellhead 12 while a second running tool 62 may be used to lower the landing assembly 42 into the wellhead 12. In addition, as described in greater detail below, the top ring 44 and the landing ring 50 of the landing assembly 42 may engage the hanger 28 through threaded surfaces. More specifically, interior surfaces of both the top ring 44 and the landing ring 50 may be threaded in the same direction (e.g., with both having either right-handed or left-handed threading) and configured to mate with threading on an exterior surface of the hanger 28 (e.g., via threads 64 and 66, respectively). However, in general, as the hanger 28 and the landing assembly 42 are lowered into the wellhead 12, relatively little rotation between the hanger 28 and the landing assembly 42 may take place. Rather, the hanger 28 and the landing assembly 42 may generally be run directly into the wellhead 12 axially along the longitudinal axis 56.

Figure 3:
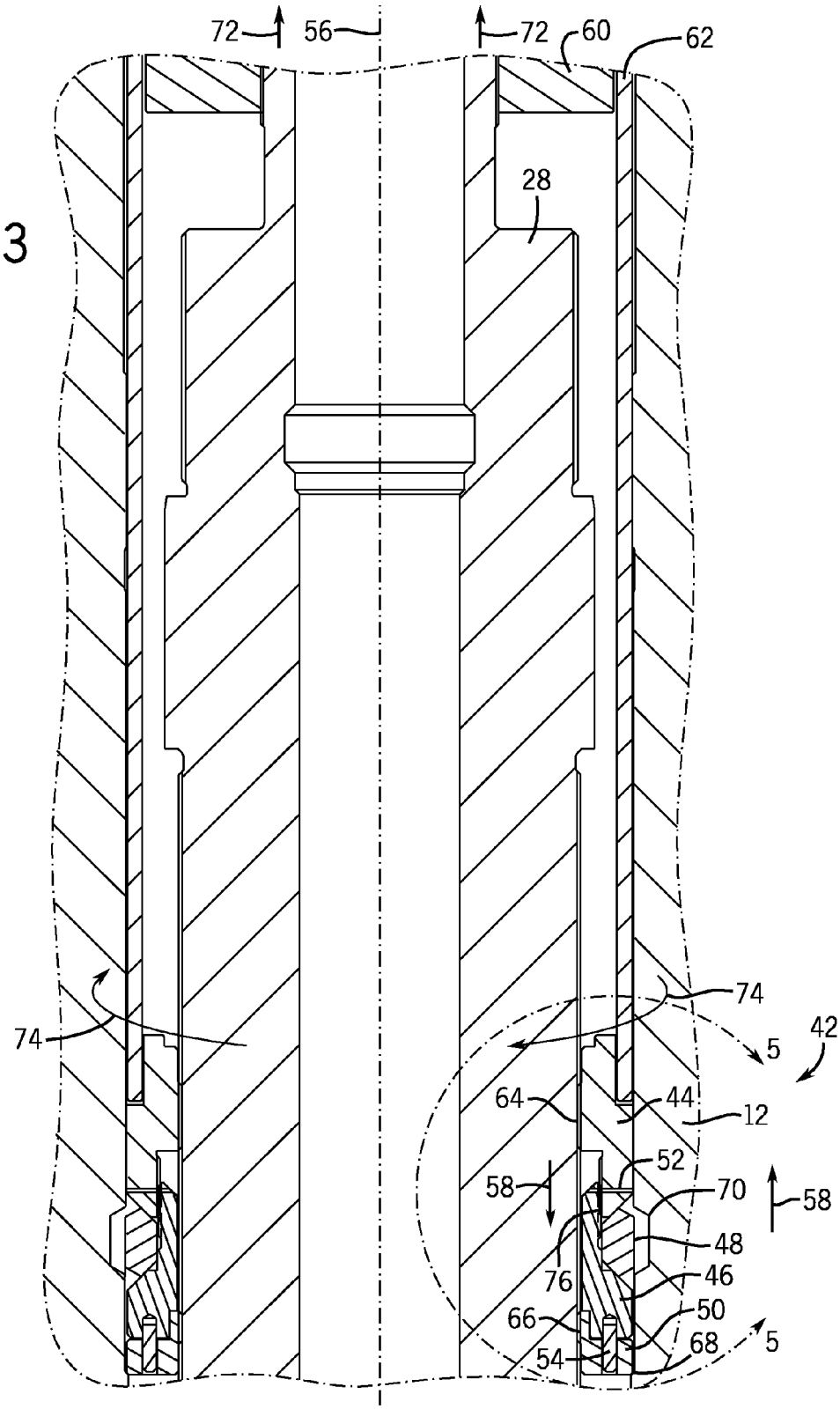
FIG. 3 is a partial cross-section of the adjustable hanger landing assembly and hanger after being run into position within the wellhead of FIG. 2.

For instance, FIG. 3 depicts a partial cross-section of the adjustable hanger landing assembly 42 and hanger 28 after being run into position within the wellhead 12 of FIG. 2. As illustrated, the landing assembly 42 and hanger 28 may be axially lowered to a point where the landing assembly 42 can be lowered no further. In particular, a small stop shoulder 68 in the wellhead 12 component (e.g., tubing spool 24, casing spool 26, and so forth) may block the landing ring 50 of the landing assembly 42 from being axially lowered further into the wellhead 12. Although illustrated as a stop shoulder 68, the mechanism used to stop the landing assembly 42 from being further lowered into the wellhead 12 may vary between implementations and may, for instance, include pins or other mechanisms for impeding the progress of the landing assembly 42 further into the wellhead 12. The stop shoulder 68 may be created by several different types of wellhead 12 components. For instance, the stop shoulder 68 may be created by another hanger 28, a seal assembly, or any other wellhead 12 components below the landing assembly 42. Indeed, the specific design for the stop shoulder 68 may be implementation-specific. However, the particular design of the mineral extraction system 10 may ensure that the stop shoulder 68 for each landing assembly 42 is in a generally appropriate location.

When the landing assembly 42 is moved into place ("landed") at the stop shoulder 68, the lock ring 48 may be axially aligned with a recess 70 in the wellhead 12 component (e.g., tubing spool 24, casing spool 26, and so forth). As described in greater detail below, the lock ring 48 may be forced radially outward into the recess 70, thereby locking the landing assembly 42 in place with respect to the wellhead 12. In addition, once the landing assembly 42 is landed at the stop shoulder 68, additional axial force may be applied to the hanger 28, as indicated by arrows 72, thereby pulling the hanger 28 upward axially. This additional force is commonly referred to as "overpull." The effect of the overpull 72 on the hanger 28 may be to ensure that the drill string is in a tensile orientation. In other words, slack in the drill string may be reduced as much as possible by the overpull 72.

Once the overpull 72 is applied to the hanger 28 and the drill string is in a suitable tensile orientation, the second running tool 62 may then be used to rotate the landing assembly 42 about the longitudinal axis 56, as indicated by arrows 74. In particular, the second running tool 62 may rotate the landing assembly 42 in a direction which, if unimpeded, would cause the landing assembly 42 to move down further along the longitudinal axis 56 of the wellhead 12, again illustrated by arrow 58. More specifically, the threading 64, 66 between the hanger 28 and the landing assembly 42 (i.e., the top ring 44 and the landing ring 50) urges the landing assembly 42 to move further downward into the wellhead 12. However, as described above, the stop shoulder 68 will block the landing assembly 42 from moving any further downward into the wellhead 12.

As such, the rotation of the landing assembly 42 applied by the second running tool 62 may begin to build internal stresses within the landing assembly 42. This is due at least in part to the fact that the torque applied by the running tool 62 onto the landing assembly 42 is unable to be released since the landing ring 50 blocks the landing assembly 42 from rotating through the threading between the hanger 28 and the landing assembly 42 via threads 64 and 66. Eventually, the stresses created by this torque may cause the shear pin(s) 52, which initially connect the top ring 44 and the bottom ring 46 of the landing assembly 42, to break.

Once the shear pin(s) 52 break, the top ring 44 and the bottom ring 46 will be free to move relative to each other. More specifically, the top ring 44 and the bottom ring 46 may be designed to engage with each other through threaded surfaces. For instance, an interior surface of the top ring 44 and an exterior surface of the bottom ring 46 may be threaded and configured to mate with each other (e.g., via threading 76). In an exemplary embodiment, the threading direction between the top ring 44 and the bottom ring 46 will be in an opposite direction to that between the hanger 28 and the landing assembly 42 (i.e., the top ring 44 and the landing ring 50). For instance, if the threading 64, 66 between the hanger 28 and the landing assembly 42 is a right-handed thread, then the threading 76 between the top ring 44 and the bottom ring 46 will be a left-handed thread. Conversely, if the threading 64, 66 between the hanger 28 and the landing assembly 42 is a left-handed thread, then the threading 76 between the top ring 44 and the bottom ring 46 will be a right-handed thread.

The guide pin(s) 54 may block the bottom ring 46 from rotating relative to the landing ring 50. In certain embodiments, the guide pin(s) 54 only allow axial translation along the longitudinal axis 56 of the bottom ring 46 relative to the landing ring 50. Once the shear pin(s) 52 have been broken, since the bottom ring 46 is only allowed to move axially relative to the landing ring 50, the bottom ring 46 begins moving upward axially (i.e., toward the top ring 44) due to the opposite threading between the top ring 44 and the bottom ring 46, as illustrated by arrow 78.

Figure 4:
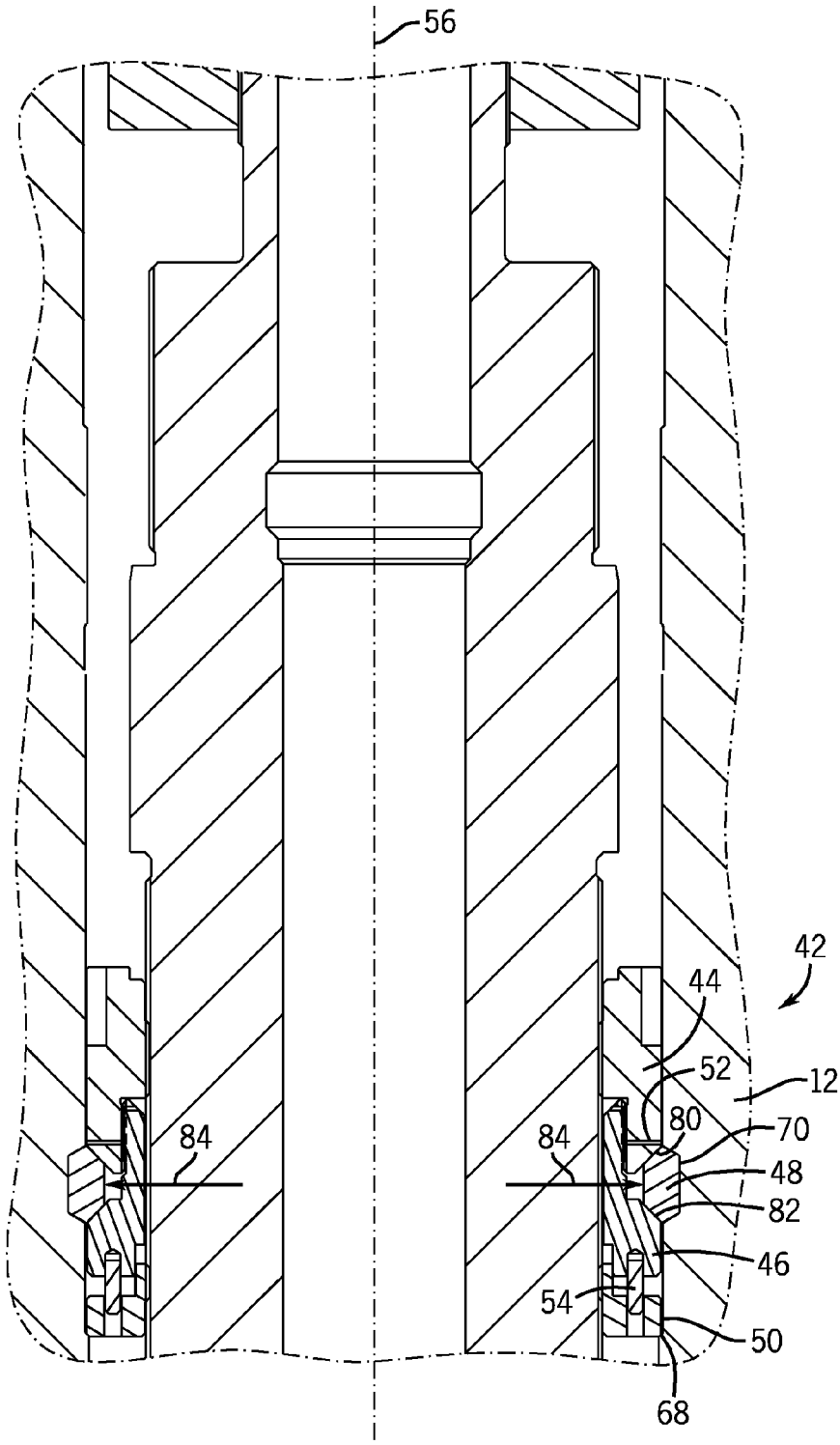
FIG. 4 is a partial cross-section of the landing assembly as the lock ring is being forced out radially into a locking position.

As the bottom ring 46 begins translating axially along the longitudinal axis 56 in an upward direction, tapered surfaces on the top ring 44 and the bottom ring 46 gradually force the lock ring 48 out radially into the recess 70 in the wellhead 12 component (e.g., tubing spool 24, casing spool 26, and so forth). FIG. 4 depicts a partial cross-section of the landing assembly 42 as the lock ring 48 is being forced out radially into a locking position within the recess 70. In particular, an angled, outwardly-facing, exterior portion of the top ring 44 may gradually apply force on an angled, outwardly-facing, interior portion of the lock ring 48 along tapered surface 80. Similarly, an angled, outwardly-facing, exterior portion of the bottom ring 46 may gradually apply force on another angled, outwardly-facing, interior portion of the lock ring 48 along tapered surface 82. As such, the lock ring 48 may gradually be forced out radially into the recess 70 of the wellhead 12, as illustrated by arrow 84. As the lock ring 48 is forced into the recess 70, the landing assembly 42 becomes locked into position within the wellhead 12.

Figure 5:
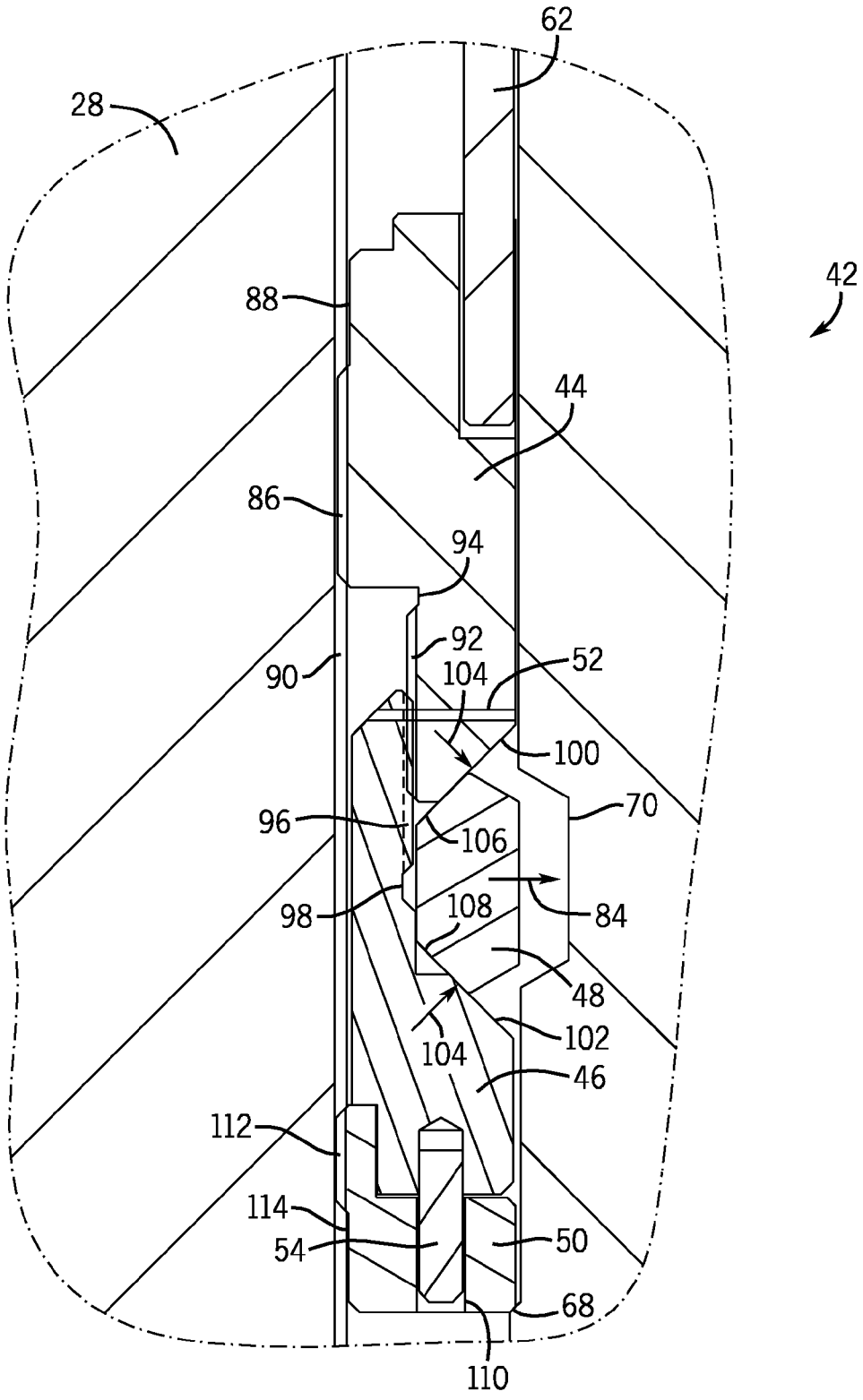
FIG. 5 is a partial cross-section of the landing assembly, further illustrating interaction between the components of the landing assembly, the hanger, and the wellhead.

FIG. 5 depicts a partial cross-section of the landing assembly 42, further illustrating interaction between the components of the landing assembly 42, the hanger 28, and the wellhead 12. For instance, as illustrated, the top ring 44 of the landing assembly 42 may, in certain embodiments, include interior threading 86 along a first interior face 88. The interior threading 86 of the top ring 44 may, as described above, engage exterior threading 90 of the hanger 28. In particular, the interior threading 86 of the top ring 44 and the exterior threading 90 of the hanger 28 may urge the top ring 44 to translate axially downward as the second running tool 62 rotates the landing assembly 42.

Also, as illustrated, at least one shear pin 52 may initially connect the top ring 44 and the bottom ring 46 of the landing assembly 42. As described above, as the landing assembly 42 is rotated by the second running tool 62, stresses within the landing assembly 42 may eventually cause the shear pin(s) 52 to break such that the top ring 44 and the bottom ring 46 become free to move relative to each other. More specifically, interior threading 92 along a second interior face 94 of the top ring 44 may engage with exterior threading 96 along an exterior face 98 of the bottom ring 46. In particular, once the shear pin(s) 52 have been broken, the interior threading 92 of the top ring 44 and the exterior threading 96 of the bottom ring 46 may urge the bottom ring 46 to translate axially upward relative to the top ring 44.

As the bottom ring 46 begins to move upward relative to the top ring 44, angled, outwardly-facing surfaces 100, 102 of the top ring 44 and the bottom ring 46, respectively, may begin applying diagonal forces 104 (e.g., converging forces) onto angled, inwardly-facing surfaces 106, 108 of the lock ring 48. These diagonal forces 104 may generally cancel each other out in the axial direction. However, the radial component of the diagonal forces 104 may gradually cause the lock ring 48 to expand radially, as again illustrated by arrow 84. Eventually, the lock ring 48 may be locked into position within the recess 70 of the wellhead 12 component (e.g., tubing spool 24, casing spool 26, and so forth).

Also, as illustrated in further detail in FIG. 5, the bottom ring 46 may include at least one guide pin 54, which may ensure that the bottom ring 46 and the landing ring 50 are only able to move axially relative to one another. In other words, the guide pin(s) 54 may block both radial movement, as well as rotational movement, between the bottom ring 46 and the landing ring 50. More specifically, each guide pin 54 of the bottom ring 46 may be configured to mate with an associated guide 110 of the landing ring 50. Although illustrated as using guide pin(s) 54 and associated guide(s) 110, the mechanisms used to ensure that the bottom ring 46 and the landing ring 50 may only move axially relative to one another may vary between implementations. In other words, any suitable blocking mechanism for this type of movement between the bottom ring 46 and the landing ring 50 may be used.

In addition, as illustrated, the landing ring 50 of the landing assembly 42 may, in certain embodiments, include interior threading 112 along an interior face 114. The interior threading 112 of the landing ring 50 may, as described above, engage exterior threading 90 of the hanger 28. In particular, the interior threading 112 of the landing ring 50 and the exterior threading 90 of the hanger 28 may urge the landing ring 50 to translate axially downward as the second running tool 62 rotates the landing assembly 42. However, as also described above, the stop shoulder 68 may block the landing ring 50 from further moving axially downward relative to the hanger 28.

Therefore, returning now to FIG. 4, the top ring 44, bottom ring 46, and landing ring 50 may all be characterized as having relatively continuous cross-sections, forming annular shapes which, for the most part, retain their radial position with respect to the hanger 28 and the longitudinal axis 56. However, the lock ring 48 may be configured to radially expand relative to the hanger 28 and the longitudinal axis 56. Several different designs may be used for the lock ring 48 to ensure that it is capable of expanding radially in this manner.

Figure 6:
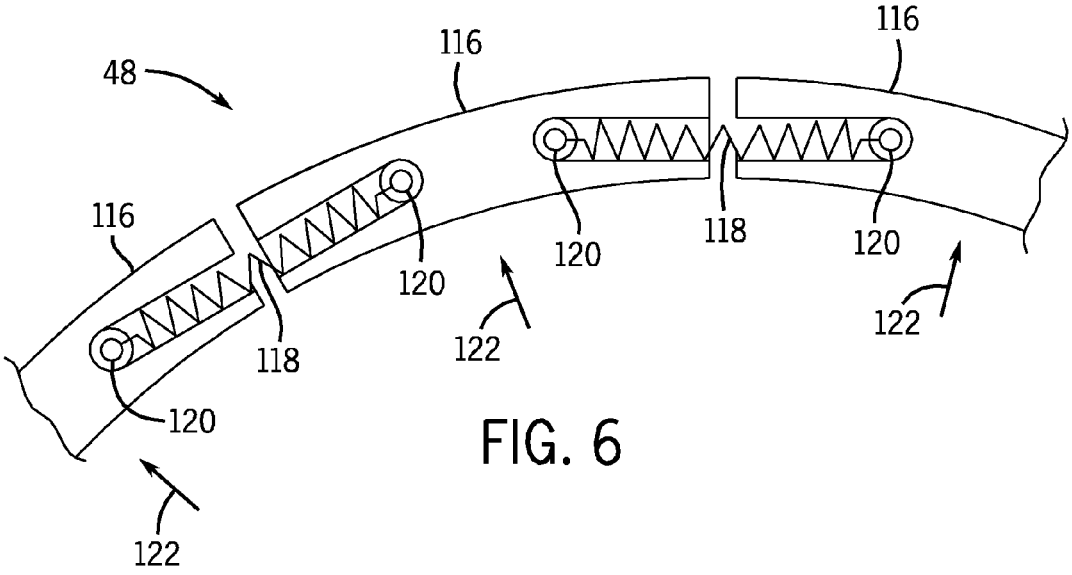
FIG. 6 is a top view of an embodiment of the lock ring utilizing segments connected by coil springs.

For instance, FIG. 6 depicts a top view of an embodiment of the lock ring 48 utilizing segments 116 connected by coil springs 118. The coil springs 118 may, for instance, be attached to the segments 116 by any suitable fastener, such as screws 120. The segments 116 of the lock ring 48 may be arranged in a circle, creating an annular formation around the hanger 28 and, more specifically, around the top ring 44 and bottom ring 46 of the landing assembly 42, as illustrated in FIGS. 2 through 4. The coil springs 118 may tend to urge the segments 116 together around the annular formation. However, radial forces 122 may begin acting on the lock ring 48 as the top ring 44 and the bottom ring 46 begin moving together axially relative to each other. These radial forces 122 cause the segments to move radially. The coil springs 118 may allow for this radial movement while still keeping the segments 116 together in an annular formation.

Figure 7:
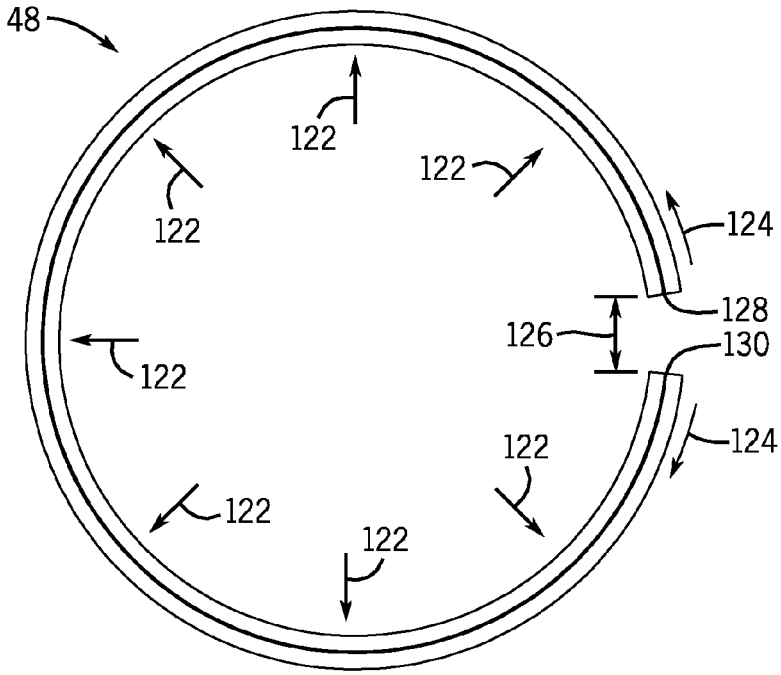
FIG. 7 is a top view of another embodiment of the lock ring utilizing a C-ring shape.

FIG. 7 depicts a top view of another embodiment of the lock ring 48 utilizing a C-ring shape. In this embodiment, as the radial forces 122 begin acting on the lock ring 48, instead of expanding in a purely radially manner, the C-ring shape of the lock ring 48 may allow for a certain degree of circumferential movement, as illustrated by arrows 124. Specifically, as the radial forces 122 act on the C-ring shape of the lock ring 48, the distance 126 between a first end 128 and a second end 130 of the C-ring shape may gradually widen. The embodiments for radially expanding lock rings 48 illustrated in FIGS. 6 and 7 are merely illustrative and not intended to be limiting. Indeed, any suitable design which allows for a radially expandable lock ring 48 may be implemented.

Figure 8:
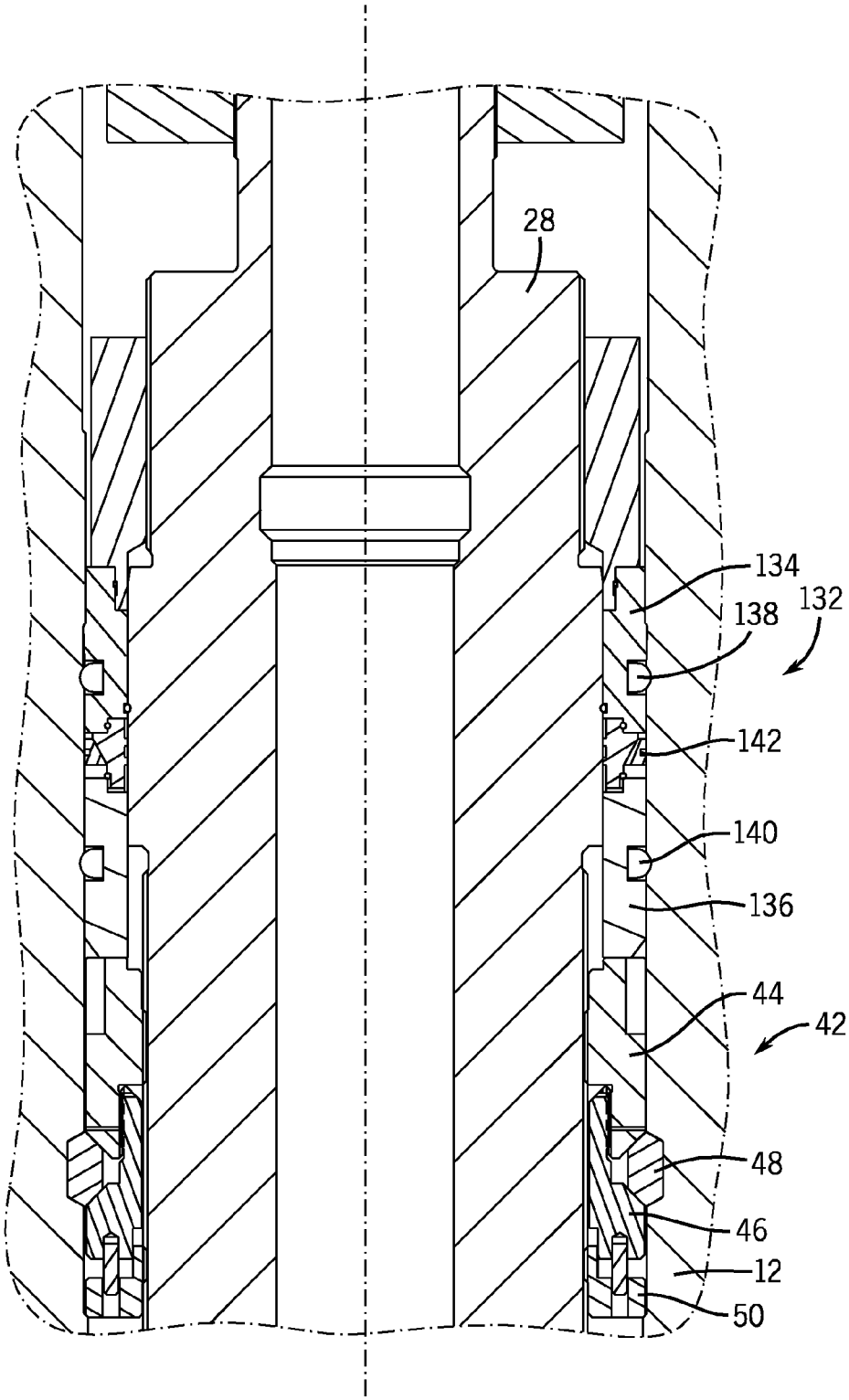
FIG. 8 is a seal assembly installed on top of the landing assembly.

Once the landing assembly 42 has been locked into place within the wellhead 12 component (e.g., tubing spool 24, casing spool 26, and so forth), other components of the mineral extraction system 10 may be placed on top of the landing assembly 42. For instance, once the second running tool 62 has been removed, a seal assembly 132 may be run into the wellhead 12. For instance, FIG. 8 depicts a seal assembly 132 installed on top of the landing assembly 42. As illustrated, the seal assembly 132 may, among other things, include an upper seal body 134, a lower seal body 136, an upper test seal 138, a lower test seal 140, and a metal seal assembly 142.

The lower seal body 136 of the seal assembly 132 may abut the top ring 44 of the landing assembly 42 when the hanger 28 is installed, landed, and sealed in the wellhead 12. In certain embodiments, the metal seal assembly 142 may include a pair of Canh seals, such as R-Canh or MRD-Canh seals, and may form a seal between the hanger 28 and the wellhead 12 component (e.g., tubing spool 24, casing spool 26, and so forth). The metal seal assembly 142 may axially separate the upper seal body 134 and the lower seal body 136. The upper test seal 138 and the lower test seal 140 may be located at exterior locations of the upper seal body 134 and lower seal body 136, respectively, and may form additional seals between the sealing assembly 132 and the wellhead 12 component (e.g., tubing spool 24, casing spool 26, and so forth).

Figure 9:
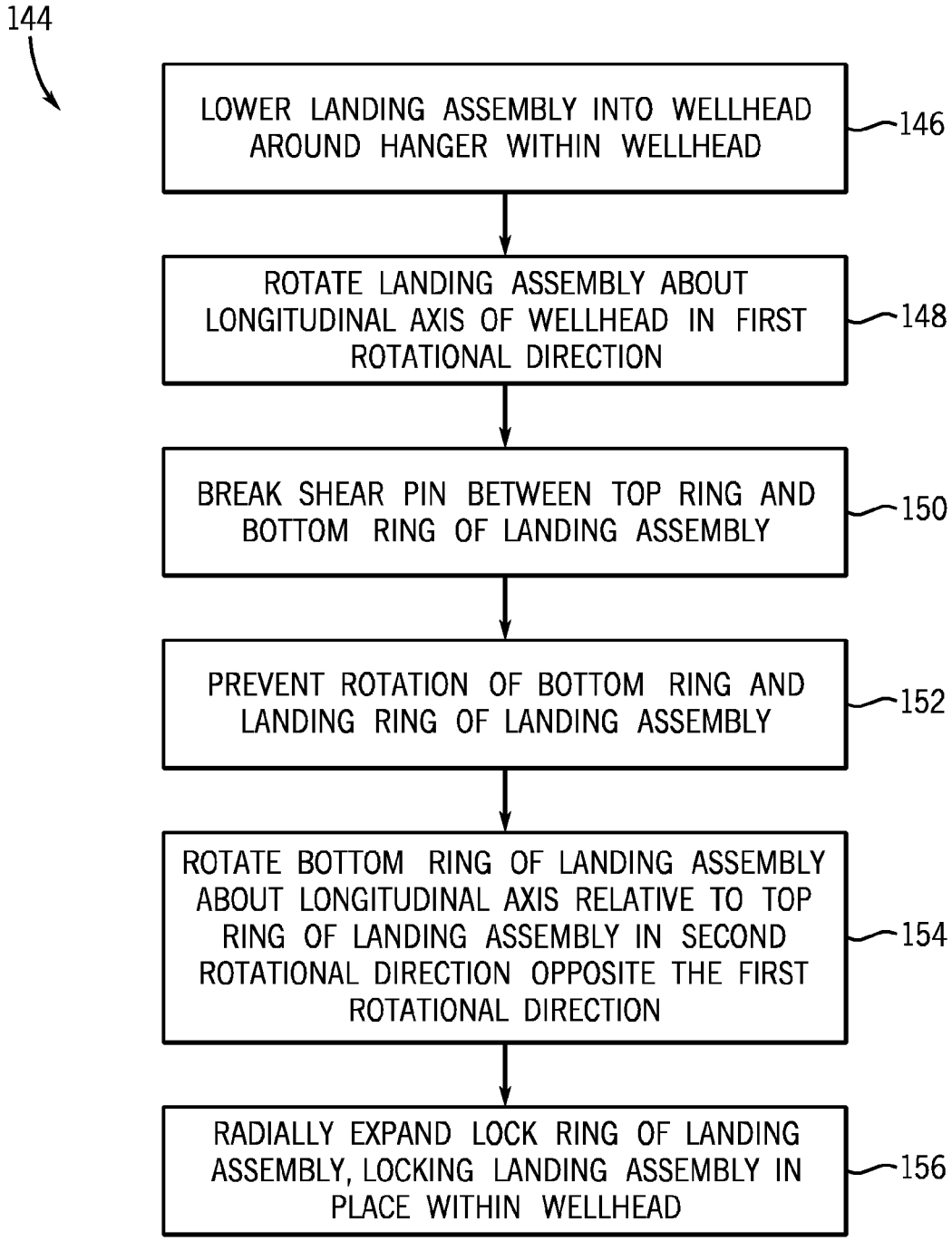
FIG. 9 is a method for locking the landing assembly in place within the wellhead.

FIG. 9 depicts a method 144 for locking the landing assembly 42 in place within the wellhead 12. The landing assembly 42 may first be lowered into the wellhead 42 around the hanger 28, as illustrated in block 146. As described above, the stop shoulder 68 of the wellhead 12 may block further lowering of the landing assembly 42. Once the landing assembly 42 has reached the stop shoulder 68, the landing assembly 42 may then be rotated about the longitudinal axis 56 of the wellhead 12 in a first rotational direction, as illustrated in block 148. As described above with respect to FIG. 3, the rotation of the landing assembly 42 about the hanger 28 may be facilitated by threading 64 between the top ring 44 of the landing assembly 42 and the hanger 28 and threading 66 between the landing ring 50 of the landing assembly 42 and the hanger 28. More specifically, the threading 64, 66 may be in a common, first rotational direction.

At least one shear pin 52 between the top ring 44 and the bottom ring 46 of the landing assembly 42 may then be broken, as illustrated in block 150. The shear pin(s) 52 may be broken as a result of internal stresses within the landing assembly 42 created by the rotation of the landing assembly 42 about the longitudinal axis 56 since the landing ring 50 is constrained from moving either axially downward or rotationally by the stop shoulder 68. As described above, rotation of the bottom ring 46 of the landing assembly 42 relative to the landing ring 50 of the landing assembly 42 may be blocked by at least one guide pin 54, as illustrated in block 152.

Once the shear pin(s) 52 between the top ring 44 and bottom ring 46 of the landing assembly 42 have been broken, the bottom ring 46 of the landing assembly 42 may rotate about the longitudinal axis 56 relative to the top ring 44 of the landing assembly 42 in a second rotational direction opposite the first rotational direction, as illustrated in block 154. As described above with respect to FIG. 3, the rotation of the bottom ring 46 relative to the top ring 44 may be facilitated by threading 76 between the top ring 44 and the bottom ring 46. More specifically, the threading 76 may be in a second rotational direction opposite the first rotational direction between the top ring 44 of the landing assembly 42 and the hanger 28 and between the landing ring 50 of the landing assembly 42 and the hanger 28.

The rotation of the bottom ring 46 relative to the top ring 44 may cause the bottom ring 46 to move axially upward 78 relative to the top ring 44. As described above with respect to FIG. 5, angled exterior surfaces 100, 102 of the top ring 44 and the bottom ring 46 apply radial forces on the lock ring 48 of the landing assembly 42. As a result, the lock ring 48 may be radially expanded, locking the landing assembly 42 in place within the wellhead 12, as illustrated in block 156. More specifically, as the lock ring 48 expands radially, it may mate with the recess 70 of the wellhead 12. As described above, the radial expansion of the lock ring 48 may be accomplished in various ways, such as having the lock ring 48 comprised of a plurality of segments 116 connected by coils springs 118, as illustrated in FIG. 6, or having the lock ring 48 include a C-ring shape, as illustrated in FIG. 7.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a landing assembly, comprising:

a top ring;

a bottom ring disposed axially below the top ring, wherein a radially interior surface of the top ring is configured to engage a radially exterior surface of the bottom ring via first threading;

a lock ring disposed between the top ring and the bottom ring on a radially exterior side of the landing assembly; and a landing ring disposed axially below the bottom ring, wherein at least one of the top ring or the landing ring comprises a second threading configured to drive the landing assembly into position between first and second tubular members.

2. The system of claim 1, wherein the landing assembly is configured to be lowered into a wellhead around a radially exterior surface of a hanger.

3. The system of claim 2, wherein the landing assembly is configured to be blocked from further lowering into the wellhead by a stop shoulder of the wellhead.

4. The system of claim 3, wherein a first radially interior surface of the top ring and a second radially interior surface of the landing ring are configured to engage the radially exterior surface of the hanger via the second threading.

5. The system of claim 4, wherein the second threading between the hanger and the top ring and the landing ring is in a common, first rotational direction.

6. The system of claim 5, wherein the first threading between the top ring and the bottom ring is in a second rotational direction opposite to the first rotational direction.

7. The system of claim 6, comprising at least one shear pin configured to hold the top ring and the bottom ring together relative to each other.

8. The system of claim 7, wherein rotation of the landing assembly about the hanger in the first rotational direction causes internal stresses within the landing assembly which cause the at least one shear pin to break, allowing movement of the top ring and the bottom ring relative to each other.

9. The system of claim 8, comprising at least one guide pin configured to constrain rotation of the bottom ring and the landing ring relative to each other.

10. The system of claim 9, wherein rotation of the landing assembly about the hanger after the at least one shear pin breaks causes rotation of the bottom ring relative to the top ring in the second rotational direction, moving the bottom ring axially upward relative to the top ring.

11. The system of claim 10, wherein both the top ring and the bottom ring comprise angled exterior surfaces.

12. The system of claim 11, wherein the angled exterior surfaces of the top ring and bottom ring are configured to force the lock ring to expand radially as the bottom ring moves axially upward relative to the top ring.

13. The system of claim 12, wherein the lock ring is configured to mate with a recess in a surface of the wellhead and to lock the landing assembly in place within the wellhead as the lock ring expands radially.

14. The system of claim 11, wherein the lock ring comprises a plurality of segments connected by coil springs.

15. The system of claim 11, wherein the lock ring comprises a C-ring shape.

16. A system, comprising:

a wellhead;

a hanger disposed within the wellhead; and a landing assembly comprising a first ring, a second ring, a lock ring disposed axially between the first and second rings, and an axial guide, wherein the landing assembly is configured to insert and lock into place between the hanger and the wellhead via a radial expansion of the lock ring into a recess in the wellhead, wherein the first and second rings are configured to cause the radial expansion of the lock ring via a rotation and an axial movement of the first and second rings relative to each other, and the axial guide blocks the rotation of the second ring while guiding the axial movement of the second ring.

17. The system of claim 16, wherein the first and second rings are coupled to one another via first threading.

18. The system of claim 17, wherein the landing assembly comprises a shear pin extending between the first and second rings.

19. The system of claim 18, wherein the landing assembly comprises a second threading configured to drive the landing assembly against an axial abutment to cause breakage of the shear pin to enable the rotation of the first ring relative to the second ring.

20. The system of claim 19, wherein the second threading is disposed on the first ring.

21. The system of claim 19, wherein the landing assembly comprises a landing ring, the axial guide extends between the landing ring and the second ring, and the second threading is disposed on at least one of the first ring and the landing ring.

22. A method for locking a landing assembly in place within a wellhead, comprising:

rotating a landing assembly along a first threading in a first rotational direction about a longitudinal axis of the wellhead to drive the landing assembly against an axial abutment, wherein the first threading is disposed on first and second portions of the landing assembly, and the first and second portions are disposed on axially opposite sides of a lock ring of the landing assembly;

breaking a shear pin between a first ring and a second ring of the landing assembly in response to a force generated after the landing assembly is rotated and driven against the axial abutment; and rotating the first ring relative to the second ring of the landing assembly about the longitudinal axis in a second rotational direction opposite to the first rotational direction after breaking the shear pin;

wherein rotation of the first ring relative to the second ring of the landing assembly causes the lock ring of the landing assembly to radially expand relative to the longitudinal axis, locking the landing assembly in place within the wellhead.

23. The method of claim 22, wherein the first threading is disposed on at least one of the first ring or a landing ring of the landing assembly.

24. The method of claim 23, wherein the first portion of the landing assembly comprises the first ring having the first threading, and the second portion of the landing assembly comprises the landing ring having the first threading.

25. The method of claim 24, wherein the first ring is a top ring and the second ring is a bottom ring.

26. The method of claim 23, comprising blocking rotation of the second ring of the landing assembly relative to the landing ring of the landing assembly via an axial guide.

27. The method of claim 23, comprising rotating the landing assembly via the first threading to drive the landing ring against the axial abutment.

28. A system, comprising:

a wellhead;

a hanger disposed within the wellhead; and a landing assembly configured to be lowered into the wellhead between the wellhead and the hanger and to lock into place between the hanger and the wellhead via a lock ring which is configured to expand radially from the landing assembly and mate with a recess in the wellhead, wherein the radial expansion of the lock ring is caused by rotation of a top ring and a bottom ring of the landing assembly relative to each other, wherein the top ring and a landing ring of the landing assembly are configured to engage the hanger via first threading having a first rotational direction.

29. A method for locking a landing assembly in place within a wellhead, comprising:

engaging a first threading on a top ring and a landing ring of the landing assembly with a second threading on a hanger;

lowering the landing assembly into the wellhead around the hanger within the wellhead until a stop shoulder of the wellhead blocks further lowering;

rotating the landing assembly about a longitudinal axis of the wellhead in a first rotational direction;

breaking a shear pin between the top ring and a bottom ring of the landing assembly;

rotating the bottom ring of the landing assembly about the longitudinal axis relative to the top ring of the landing assembly in a second rotational direction opposite to the first rotational direction;

wherein rotation of the bottom ring of the landing assembly relative to the top ring of the landing assembly causes a lock ring of the landing assembly to radially expand, locking the landing assembly in place within the wellhead.

* * * * *